United States Patent [19]

Zickler

[11] Patent Number: 4,996,847

[45] Date of Patent: Mar. 5, 1991

[54] THERMOELECTRIC BEVERAGE COOLER AND DISPENSER

[76] Inventor: Melissa Zickler, 400 So. Detroit St. #410, Los Angeles, Calif. 90036

[21] Appl. No.: 453,859

[22] Filed: Dec. 20, 1989

[51] Int. Cl.[5] ..... F25B 21/02

[52] U.S. Cl. ..... 62/3.64; 62/389; 62/394; 165/185

[58] Field of Search ..... 62/3.64, 3.7, 389, 394; 222/146.6; 165/185

[56] References Cited

U.S. PATENT DOCUMENTS 2,057,238 10/1936 Krug ..... 62/389

2,203,365 10/1938 Rice ..... 62/394

3,250,433 5/1966 Christine et al. ..... 62/3.64

*Primary Examiner*—Albert J. Makay

*Assistant Examiner*—John Sollecito

*Attorney, Agent, or Firm*—Iman Abdallah

[57] ABSTRACT

A beverage cooler and dispenser wherein bottled beverages are received into a housing member and the beverage therein is transferred by gravity to a cooling chamber comprising honeycombed beverage passageways. The beverage is thermoelectrically cooled within the honeycombed passageways and selectively dispensed from the cooling chamber via a spigot fixedly attached to said housing member.

3 Claims, 2 Drawing Sheets

THERMOELECTRIC BEVERAGE COOLER AND DISPENSER

BACKGROUND OF THE INVENTION

The present invention generally relates to portable beverage dispensers. More particularly, the present invention relates to improved means for cooling bottled beverages in a portable dispenser.

Portable dispensers for water, soda and like beverages are widely known in the prior art. Beverage cooling in the dispensers of the prior art has generally been accomplished by cooling a tank or container housing the beverage. In U.S. Pat. No. 3,149,471 to Boehmer et al. a water cooler is disclosed wherein water disposed in a container is chilled by a thermoelectric assembly. In U.S. Pat. No. 3,310,953 to Rait a portable casing having a thermoelectric cooling assembly attached thereto is provided for receipt of a container of beverage for conductive cooling. A portable dispenser for pressurized kegs of beer and the like is disclosed in U.S. Pat. No. 3,354,668 to Cserny wherein a thermoelectric refrigeration unit is provided to cool the interior of a cabinet housing the keg of beer. U.S. Pat. No. 4,823,554 to Trachtenberg et al. discloses a thermoelectric heating and cooling apparatus which selectively raises or lowers the temperature of a conductive plate whereupon food or beverage items are placed.

A particular shortcoming of the aforementioned beverage dispensers of the prior art is the provision of only a single heat transfer wall for removal of heat. Such construction necessitates a longer cooling period to chill a quantity of beverage. It is well known as a basic principle of thermodynamics that the rate of heat transfer is directly proportional to the surface area of the conducting wall. Thus, more efficient cooling can be accomplished by increasing the thermoconductive surface area. In U.S. Pat. No. 3,312,083 to Scoggins et al. a portable home soda fountain is disclosed wherein a cooling coil is wrapped around a beverage tank thereby increasing the conductive surface area. In U.S. Pat. No. 3,468,370 to Castillo a bottled water cooler is disclosed which includes baffling means to direct fluid to the cooling means. While these improvements in cooling means for beverage dispensers enhance cooling efficiency, they do not provide a simple construction for this purpose as disclosed in the present invention.

SUMMARY OF THE INVENTION

The present invention provides a thermoelectrically-cooled beverage dispenser having a cooling chamber formed with honeycombed beverage passageways, such construction providing a larger conductive surface area per volume of beverage. The beverage dispenser includes an orifice and recessed chamber in its top wall for receipt of a bottled beverage.

An object of the present invention is to provide an apparatus for dispensing and cooling beverages.

Another object of this invention is to provide a beverage dispenser adaptable for receipt of bottled beverages.

It is also an object of the present invention to provide a beverage dispenser having more efficient cooling means.

These and other objects and advantages of the present invention will be apparent to those skilled in the art from the following description of a preferred embodiment, claims, and accompanying drawings.

DESCRIPTION OF A PREFERRED EMBODIMENT

Figure 1:
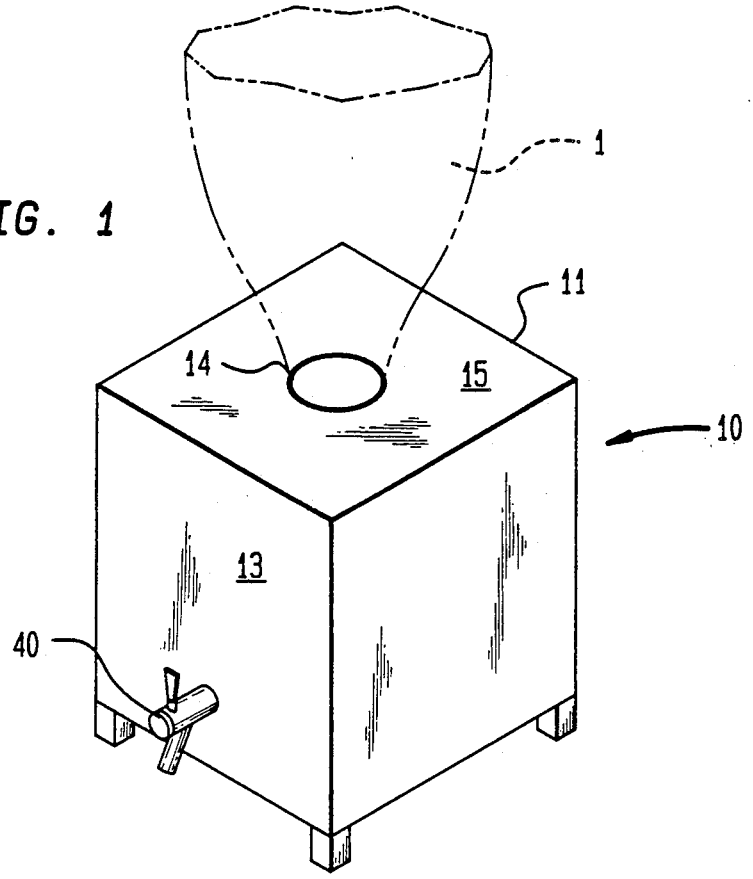
FIG. 1 is a front perspective view of the present invention.
Figure 2:
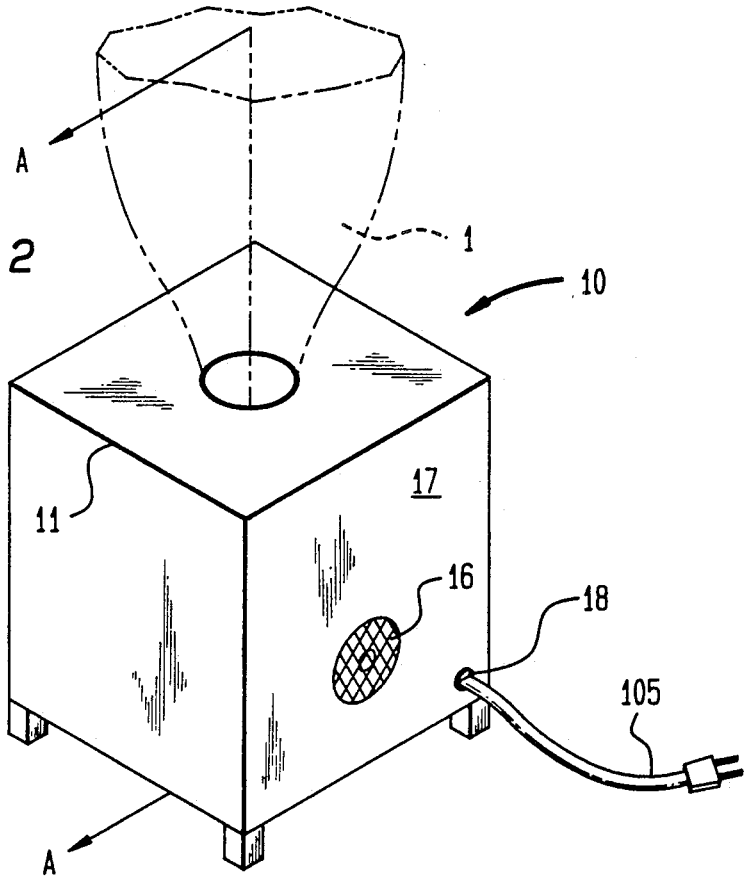
FIG. 2 is a rear perspective view of the present invention.

FIG. 1 illustrates in a front perspective view the beverage dispensing and cooling apparatus 10 of the present invention. The beverage dispenser 10 generally comprises a quadrilateral housing 11 having a selectively operable spigot 40 disposed in the lower portion of the front wall 13 of said housing 11. A beverage container orifice 14 is formed in the top wall 15 of said housing 11 for receipt of the top portion of a bottled beverage 1, shown in phantom line in the several figures, which communicates with the cooling assembly 100 of said dispenser 10 (FIG. 3) as hereinafter described in greater detail. As can be seen in FIG. 2, beverage dispenser 10 further includes a fan vent 16 formed in the rear wall 17 of said housing 11 and an electrical cord outlet 18 likewise formed in the rear wall 17 for passage of the electrical source attachment 105.

Figure 3:
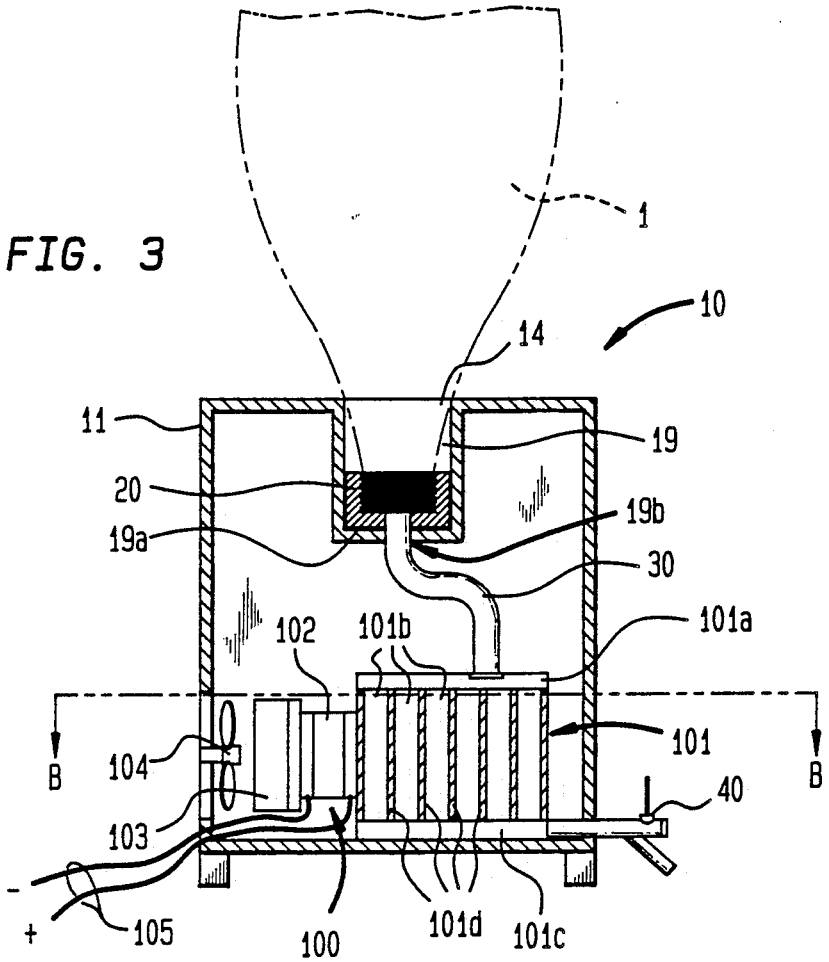
FIG. 3 is a plan cross-sectional view taken along line A—A in FIG. 2.

Referring now to FIG. 3 it can be seen that the beverage container orifice 14 communicates with a recessed chamber 19 formed in the top portion of the dispenser housing 11. A screw cap 20 is disposed adjacent to the bottom wall **19*a* of said recessed chamber 19, said screw cap 20 being threadedly attachable to the end of said bottled beverage 1. Screw cap 20 includes a opening 21 formed in its bottom wall in vertical alignment with a chamber opening 19*b* through which a flexible tubing 30 extends in snug engagement. One end of said flexible tubing 30 extends into the end of said bottled beverage 1 and the opposite end of said tubing 30 extends to the cooling chamber 101 of said cooling assembly 100**.

Figure 4:
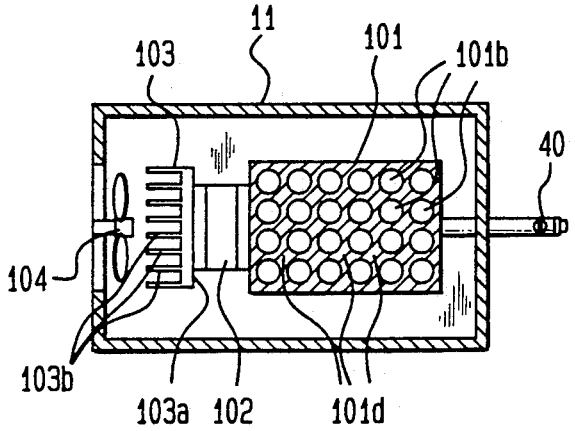
FIG. 4 is a plan cross-sectional view taken along line B—B in FIG. 3.

Cooling assembly 100 includes a cooling chamber 101, preferably formed from a highly thermoconductive material, for example, aluminum, a thermoelectric module 102 disposed adjacent to a wall of said cooling chamber 101 in heat exchange relationship, a heat sink 103 attached to the opposite side of said thermoelectric module 102 and a heat fan 104 disposed adjacent to the heat sink 103 and attached to the heat vent 16 of said dispenser housing 11. Cooling chamber 101 has a fluid baffling compartment **101*a* formed at the top of chamber 101 which communicates with honeycombed tubular passageways 101*b* which vertically extend to a fluid dispensing compartment 101*c* formed at the bottom of chamber 101. The thermoelectric module 102 of said cooling assembly 100 includes appropriately attached lead wires 105 to induce the charge flow across said module 102 for thermoelectric operation. As can be seen in FIG. 4 the heat sink 103 includes a base element 103*a* and a plurality of fins 103*b*** extending therefrom.

To utilize the beverage dispenser 10 of the present invention, the screw cap 20 is threadedly attached to the top end of an open bottled beverage 1, for example a liter of bottled water, and the beverage 1 is then inverted through the orifice 14 of the dispenser housing 11 into the recessed chamber 19. Gravity flow of the beverage through the flexible tubing 30 fills the cooling chamber 101. The beverage 1 trapped in the honeycombed passageways 101*b* of the cooling chamber 101 is then cooled by operation of the thermoelectric module 102, the heat transmitted to the heat sink 103 being vented by the heat fan 104. The thin walls 101*d* of the cooling chamber 101 which surround the passageways 101*b* provide a greater surface area per volume of beverage 1 and thereby permit more efficient cooling of the beverage 1 enclosed therein. The cooled beverage 1 is then selectively dispensed from the dispensing compartment 101*c* of the cooling chamber 101 via the spigot 40.

Therefore, in view of the foregoing I claim:

1. A portable cooling and dispensing apparatus for bottled beverages comprising a housing member having bottled beverage receiving means formed in the top portion of said housing member and heat venting means formed within a wall of said housing member;

a cooling assembly disposed within the interior of said housing member, said cooling assembly being connected to said bottled beverage in a manner to permit gravity flow of the beverage from said bottle to said cooling assembly, said cooling assembly providing means to chill a quantity of beverage retained therein, said cooling assembly comprising a cooling chamber having a fluid baffling compartment formed at the top portion of said chamber which communicates with honeycombed tubular passageways which vertically extend to a fluid dispensing compartment formed at the bottom portion of said chamber, a thermoelectric module having a side disposed in heat exchanger relationship to one side of said cooling chamber, a heat sink disposed to the opposite side of said thermoelectric module, and a venting fan disposed adjacent to said heat sink which communicates with the heat venting means of said housing member; and a spigot fixedly attached to said housing member which communicates with said cooling assembly providing means to selectively dispense chilled quantities of beverage.

2. A portable cooling and dispensing apparatus for bottled beverages comprising a housing member having bottled beverage receiving means formed in the top portion of said housing member and heat venting means formed within a wall of said housing member, said bottled beverage receiving means comprising an orifice formed in the top wall of said housing member which communicates with a recessed chamber formed in the top portion of said housing member, said recessed chamber having an opening formed in its bottom wall;

a cooling assembly disposed within the interior of said housing member, said cooling assembly including a cooling chamber having a fluid baffling compartment formed at the top portion of said chamber, a fluid dispensing compartment formed at the bottom portion of said chamber, and honeycombed tubular passageways vertically disposed between said baffling compartment and said dispensing compartment, a thermoelectric module having a side disposed in heat exchanger relationship to one side of said cooling chamber, a heat sink disposed to the opposite side of said thermoelectric module, and a venting fan disposed adjacent to said heat sink which communicates with the heat venting means of said housing member, said cooling assembly being connected to said bottled beverage by gravity flow connection means, said gravity flow connection means including a screw cap threadedly attachable to the top end of said gohled beverage; said screw cap including an opening formed therein which aligns with the opening formed in the recessed chamber of said housing member, said gravity flow connection means further including a length of flexible tubing which extends through the opening of said recessed chamber and the opening of said screw cap to the interior of said bottled beverage at one end and to the cooling chamber of said cooling assembly at the opposite end, said cooling assembly providing means to chill a quantity of beverage retained within said honeycombed passageways; and a spigot fixedly attached to said housing member which communicates with said dispensing compartment thereby providing means for selective dispensation of chilled quantities of beverage.

3. A portable cooling and dispensing apparatus for liquid beverages comprising a housing member having beverage receiving means and heat venting means formed in said housing member;

a cooling assembly disposed within the interior of said housing member which communicates with said beverage receiving means and said heat venting means, said cooling assembly including a cooling chamber having a beverage baffling compartment, a beverage dispensing compartment, and a thermoconductive material provided with an array of beverage passageways disposed between said baffling compartment and said dispensing compartment, and means to cool beverage retained within said cooling chamber said cooling assembly comprised of a thermoelectric module having a side disposed in heat exchange relationship to one side of said cooling chamber and a heat sink disposed to the opposite side of said thermoelectric module; and means attached to said dispensing compartment for selective dispensation of beverage from said dispensing compartment.

* * * * *